US006701896B2

(12) United States Patent
Kiessling

(10) Patent No.: US 6,701,896 B2
(45) Date of Patent: Mar. 9, 2004

(54) MICROELECTRONIC IGNITION METHOD AND IGNITION MODULE WITH IGNITION SPARK BURN-TIME PROLONGING FOR AN INTERNAL COMBUSTION ENGINE

(75) Inventor: Leo Kiessling, Cadolzburg (DE)

(73) Assignee: Prufrex-Elektro-Apparatebau, Inh. Helga Müller, geb. Dutschke, Cadolzburg (DE)

( * ) Notice: Subject to any disclaimer, the term of this patent is extended or adjusted under 35 U.S.C. 154(b) by 0 days.

(21) Appl. No.: 10/211,608

(22) Filed: Aug. 2, 2002

(65) Prior Publication Data

US 2003/0089336 A1 May 15, 2003

(30) Foreign Application Priority Data

Nov. 13, 2001 (DE) ..... 101 55 484
Jul. 18, 2002 (DE) ..... 102 32 756

(51) Int. Cl.[7] ..... F02P 5/00
(52) U.S. Cl. ..... 123/406.57; 123/149 D
(58) Field of Search ..... 123/406.57, 149 D, 123/406.11, 406.56, 406.12, 406.19, 406.65, 149 C

(56) References Cited

U.S. PATENT DOCUMENTS 3,761,779 A * 9/1973 Carlsson ..... 361/258
3,963,015 A * 6/1976 Haubner et al. ..... 123/651
4,727,851 A * 3/1988 Orova ..... 123/406.56
5,069,193 A * 12/1991 Erhard ..... 123/335
5,105,794 A * 4/1992 Fukuda ..... 123/651
5,111,798 A * 5/1992 Notaras et al. ..... 123/637
5,635,801 A * 6/1997 Regazzi et al. ..... 315/209 CD
5,954,037 A * 9/1999 Grimes ..... 123/640
6,571,769 B2 * 6/2003 Uemura ..... 123/406.57

* cited by examiner

*Primary Examiner*—John Kwon
(74) *Attorney, Agent, or Firm*—Frank H. Foster; Kremblas, Foster, Phillips & Pollick

(57) ABSTRACT

An electrical ignition for internal combustion engines having coils and a magnetic generator that rotates synchronously with the engine. The generator's magnetic field passes periodically through the coils and induces a sequence of corresponding alternating-voltage half-waves. These charge an energy-storage element, that is discharged by actuation of an ignition switch to trigger an ignition spark and they form the voltage supply of a microelectronic and/or programmable control that actuates the ignition switch in an ignition time instant as a function of the detected half-waves and/or of a rotational state of the engine. Within one rotation, there is chosen, for the triggering of the ignition spark to prolong its burn-time, a time interval in which the primary and/or secondary coil winding is influenced by one of the half waves and the amount or range of the magnetic flux change used to prolong the burn-time is greatest within the respective sequence.

23 Claims, 5 Drawing Sheets

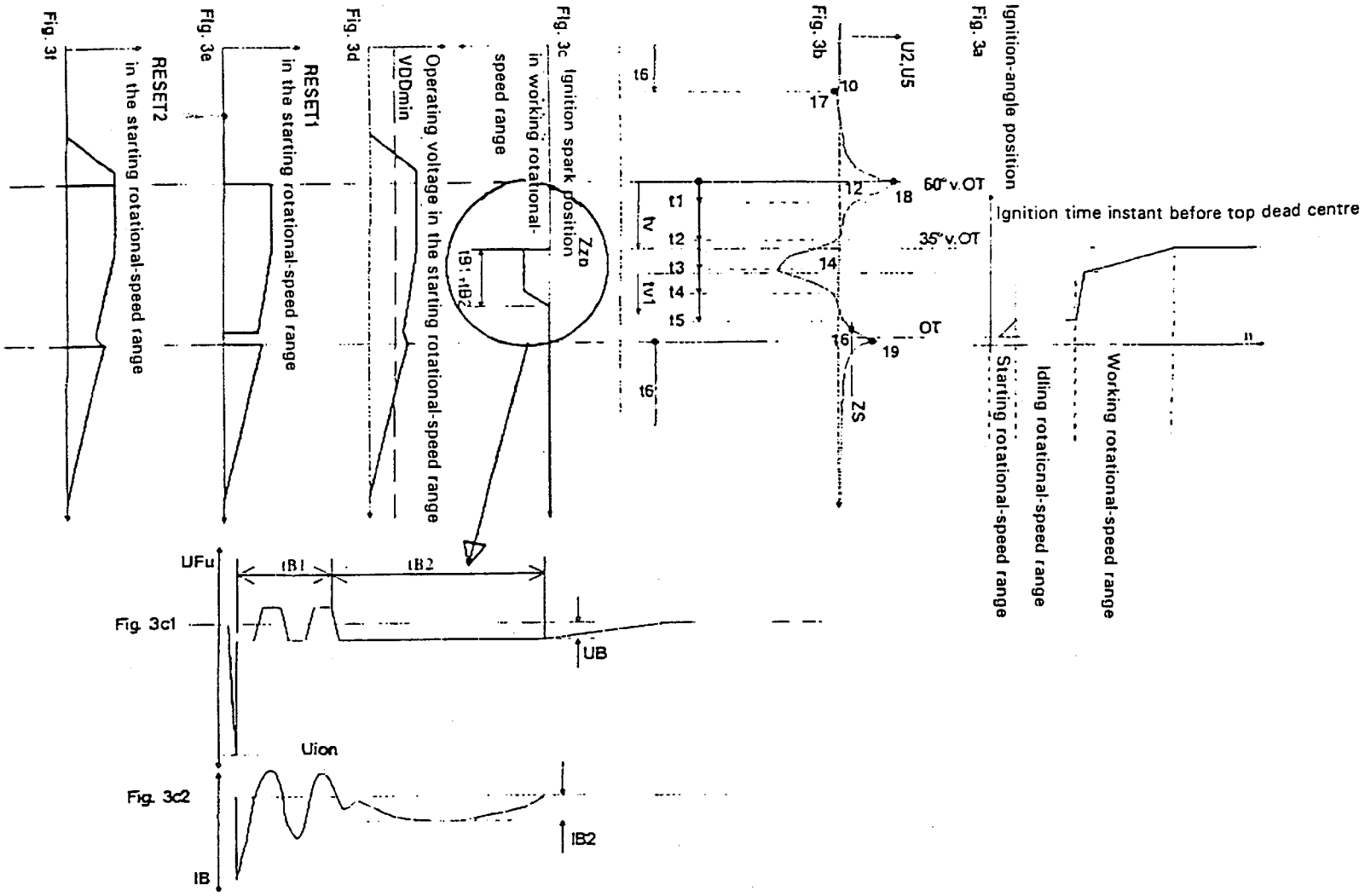
Ignition time instant before top dead centre
n
Working rotational-speed range
Idling rotational-speed range
Starting rotational-speed range
Ignition-angle position
Fig. 3a
60° v.OT
35° v.OT
OT
U2,U5
ZS
Fig. 3b
Fig. 3c
Ignition spark position
in working rotational-speed range
Zzp
Operating voltage in the starting rotational-speed range
VDDmin
Fig. 3d
RESET1
in the starting rotational-speed range
Fig. 3e
RESET2
in the starting rotational-speed range
Fig. 3f
UB
IB2
IB1
UFu
Uion
IB
Fig. 3c1
Fig. 3c2

MICROELECTRONIC IGNITION METHOD AND IGNITION MODULE WITH IGNITION SPARK BURN-TIME PROLONGING FOR AN INTERNAL COMBUSTION ENGINE

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

The invention relates to an electrical ignition method for internal combustion engines using an arrangement of a plurality of coils and of a magnetic generator that rotates synchronously with the engine and whose magnetic field at the same time passes periodically through the coils and generates therein a sequence of magnetic flux changes per rotation. In this process, a sequence of corresponding alternating-voltage half-waves is induced in the coils. These are used:

- to charge an energy-storage element, that is discharged by actuation of an ignition switch via the primary-coil winding of an ignition transformer to trigger an ignition spark, and
- to form the voltage supply of a microelectronic and/or programmable control (for example, a microcontroller) that is used to actuate the ignition switch in an ignition time instant as a function of the alternating-voltage half-waves detected and/or of the state of the internal combustion engine, for example its rotational position or rotational speed.

Furthermore, the invention relates to an ignition module suitable for performing the generic ignition method that has a magnetizable yoke core surrounded by a plurality of induction coils. The latter is constructionally and geometrically formed with a first and a second limb. The first limb is surrounded by a charging coil, whereas the second limb is surrounded at least by the primary and secondary coils of an ignition transformer. The energy-storage element is connected to the charging coil. Furthermore, the invention relates to a computer-program product having program-coding elements that are provided to execute the programmable control in order to implement the said method.

2. Description of the Related Art

To achieve a prolonged burn-time and a high spark energy, it is known from U.S. Pat. No. 4,538,586 to trigger the ignition spark in an angular range in which a flux change is effected precisely in the core of the ignition transformer by the magnet wheel of the magnetic generator rotating past. This induces a voltage in the secondary coil of the ignition transformer that is used to prolong the burn-time and to enhance the energy of the ignition spark. As a result, the fuel mixture in the internal combustion engine ignites more reliably. Specifically, it is proposed to use only a subsidiary flux change to prolong the burn-time, namely to trigger the ignition process at the start of the last, second-greatest alternating-voltage half-wave, from the point of view of amplitude magnitude, of a half-wave sequence. This achieves in any case a reduced attenuation of the main-flux change, which is used for the charging phase preceding the ignition.

From DE 38 17 187 C2, it is known to derive voltage half-waves that do not correspond to a forward direction by means of a diode in an ignition circuit and thereby to contribute to an uninterrupted, attenuated oscillation in the primary winding of the ignition transformer and in the charging capacitor discharging via it. This is intended to ensure a long spark burn-time. The circuit, which does not have a microelectronic and/or programmable control, causes, in a comparable way to U.S. Pat. No. 4,538,586 or U.S. Pat. No. 5,513,619, only small current consumption from the charging coil in the angular range of the ignition.

U.S. Pat. No. 5,513,619 (see, in particular, FIG. 6*b* therein) discloses an ignition module roughly of the type mentioned at the outset having a two-limb coil arrangement. The first limb in the rotational direction of the magnet wheel is surrounded by the ignition coil 124 and the subsequent, second limb is surrounded by a charging coil 126. Again, the ignition time instant takes place precisely when a voltage is induced in the secondary coil of the ignition transformer by magnetic flux change, as a result of which the burning of the ignition spark is maintained for as long as possible. However, this ignition system does not provide a possibility of flexibly adjusting the ignition time instant by flexible adjustment to various magnet wheel/yoke-core limb geometries of diverse internal combustion engine types.

DE 197 36 032 A1 discloses an ignition method roughly of the type mentioned at the outset, in which only the first limb in the direction of rotation of a two-limb, roughly U-shaped yoke core serves to promote and intensify the magnetic flux in the coils used to charge and trigger and also in the ignition transformer. To increase the technical reliability and safety, it is proposed to reset ("RESET") or initialize the programmable control (for example, single-chip microcomputer) at least once to its initial state within every engine rotation in order to eliminate any adverse interference effects present externally in a sustained manner. Furthermore, the problem of guaranteeing the burn-time of the ignition spark is mentioned for the case where the activation signal of the microcontroller or of the control stops at the ignition switch during the capacitor discharge, for example owing to an interference effect due to the ignition spark. For this purpose, it is proposed to design the discharge-current circuit in such a way that the discharge of the energy-storage element is started by a short pulse from the microcontroller and the discharge process is maintained by a differentiating element until discharge is adequate. However, in that case, a special complexity of the specific circuit configuration of the differentiating element has to be implemented so that a residual charge still remains in the energy-storage element after termination of the discharge process, as it were, as "free charge" for the next ignition spark triggering with then correspondingly prolonged ignition-spark time. Furthermore, it is again proposed to use only a subsidiary flux change to prolong burn-time, namely to trigger the ignition process at the start of the first alternating-voltage half-wave of a half-wave sequence. In any case, this makes possible a reliable orientation of the control in regard to angular position on the basis of the subsequent half-waves.

With regard to the further prior art, reference is made to U.S. Pat. Nos. 5,392,735, 4,924,831, 6,009,865, DE 40 17 478 and EP 0 394 656 B1.

In contrast, the object of the invention is to develop, avoiding the abovementioned disadvantages, a generic ignition method further in such a way that a prolonging of the ignition-spark burn-time (so-called top-up effect) can be achieved without additional circuit complexity with simultaneous optimization of the energy content of the ignition spark.

BRIEF SUMMARY OF THE INVENTION

To achieve this in an ignition method having the features mentioned at the outset, it is proposed, according to the invention, that within one rotation, there is chosen, for the triggering of the ignition spark to prolong its burn-time, such a time interval in which the primary and/or secondary coil winding of the ignition transformer is specifically influenced by one of the magnetic flux changes and the amount or range of the magnetic flux change used to prolong the burn-time is greatest within the respective sequence. This departs from the method prevailing in the prior art mentioned at the outset of using only the last magnetic flux change of a sequence for triggering the ignition and for supplying the ignition transformer with energy. Instead, the ignition time instant or the position of the ignition angle relative to the flux change is set in such a way that, in this rotation-angle range or angular interval, the strongest magnetic flux change (so-called main flux change), triggered by the magnetic generator magnet wheel rotating past, comes into effect in the secondary coil of the ignition transformer. In a continuation of the inventive idea, said magnetic flux change can then be available solely for prolonging burn-time because energy does not then have to be drawn either from the coils for charging the energy-storage element or for supplying voltage to the microcontroller. This makes possible a continued burning of the ignition spark over a spark gap with a maximum current or with maximum spark energy.

Within the scope of an inventive alternative, the prolonging of the burn-time and the inductive topping-up of the ignition energy can also be effected in that, in the chosen time interval of the magnetic flux change, use of the alternating-voltage half-waves has been or is excluded at least for the formation of the voltage supply to the microcontroller or to the control. Since the effect of a magnetic flux change and, consequently, induced alternating-current half-wave is in this way no longer diminished by energy withdrawal for the microcontroller voltage supply, a prolonging of the burn-time already improved compared with the prior art can be produced in conjunction with a flexibly programmable ignition-time adjustment.

An advantage achievable jointly with the two inventive alternatives is that even less energy is necessary to initiate the ignition spark. As a further advantageous consequence, an ignition capacitor having a comparatively low capacitance, for example 0.47 $\mu$F instead of 0.68 $\mu$F or 1 $\mu$F, can be used as energy-storage element, which results in an advantage in regard to overall volume and costs.

According to a further refinement, the position of the ignition time instant or of the ignition angle referred to the magnetic generator rotation is correlated with the magnetic flux changes passing through the coils in such a way that, in the time interval comprising the ignition time instant, use of the alternating-voltage half-waves has been or is excluded also for charging the energy-storage element. Consequently, the magnetic flux change that is possibly the strongest (greatest size or extent) can be used solely to prolong the burn-time.

In accordance with a refinement of the invention, a coil arrangement is used that extends constructionally and geometrically over two distinct limbs, preferably of an iron or yoke core, preferably U-shaped. In this case, the first and then the second magnetic pole of the magnetic generator are each consecutively moved past the first and then the second limb within a full rotation. Advantageously, in this case, the magnetic flux change taking place in the second limb and at the third point therein per rotation or sequence is fed directly to the ignition transformer. The effect achieved is the efficient prolonging of the ignition-spark burn-time. In addition, the coil interactions can be reduced by the distribution of the coils over two limbs (remote from one another), as a result of which the alternating-voltage half-waves produced by the coils, in particular, are attenuated less during energy withdrawal.

This pursues the path to a further inventive development, namely to utilize the magnetic flux changes occurring in the first and second limb per rotation or sequence in each case at the second point in time or resultant alternating-voltage half-waves across the coils of the respective limbs in parallel and/or roughly simultaneously to charge the energy-storage element and to supply voltage to the control. Because of the arrangement on different limbs, mutual attenuation of the charging coil and of the voltage-supply coil takes place only to a considerably reduced extent. On this basis, a further development is expedient according to which, to form the voltage supply, one of the alternating-voltage half-waves of the second limb is utilized within the respective rotation or sequence in that time interval in which the magnetic flux change and/or resultant half-wave having the greatest size or extent occurs in the first limb. The latter can be used in an advantageous development to charge the energy-storage element. The voltage supply to the control therefore takes place during the second-strongest or third-strongest magnetic flux through the ignition coil and the charging phase of the energy-storage element, in particular ignition capacitor, the strongest flux change taking place in the charging coil.

With particular advantage, the energy-storage element, in particular ignition capacitor, can be charged within the respective rotation or sequence with two half-waves, preferably the second, in particular strongest/greatest, and fourth or last of a half-wave sequence. As a result, the energy-storage element is already precharged at the end of a half-wave sequence and is further charged in the next half-wave sequence with the second and, in particular, strongest half-wave sequence. The energy-storage element therefore experiences the main charge as a result of the main flux change in the charging coil. This is expedient, particularly at high rotational speeds, where the maximum charging of the energy-storage element is no longer achieved owing to the shorter rotation time.

Using the two-limb coil arrangement, it is possible, on the basis of the invention, to utilize the respective strongest magnetic flux change in each limb, on the one hand, to charge the energy-storage element and, on the other, to top up energy in the secondary coil in the ignition time range.

A further advantage of the two-limb coil arrangement emerges from the inventive development according to which alternating-current half-waves of the coils of the two limbs are fed to the control for processing and, in this process, the half-waves of different coils are set in time relationship to one another within the control. From this, the control can determine by means of suitable evaluation software, for example, the direction of rotation, the rotational position and/or the rotational speed of the magnetic generator or of the internal combustion engine. Depending on this, the adjustment and the triggering time instant for the ignition spark can in turn be calculated or flexibly set within the control.

In the starting rotational-speed range, the rotational speeds and the corresponding magnetic flux changes are relatively low, with the result that an economical utilization of the induced electrical energy is offered. The invention therefore strives to help to supply the control with operating voltage only over a minimum angular range prior to the ignition time instant. Correspondingly, according to an inventive development, the ignition time instant is determined, adjusted and/or triggered within a time interval by means of the control, at any rate if the internal combustion engine is running in the starting rotational-speed range, which time interval corresponds as a maximum to a rotation of the magnetic generator by up to about 80°. Expediently, all the data relevant to triggering the ignition time instant are obtained from the half-wave signals of the control within this relatively small angular range and evaluated.

Depending on different types of internal combustion engine, the spacing of the ignition time instant from top dead center in the working rotational-speed range may differ from that in the starting rotational-speed range. In order, nevertheless, to be able to use similarly constructed coil arrangements and ignition modules for different engines, flexibility of the angle-related ignition triggering has to be strived for by the respective ignition module. In this regard, it is advantageous if, according to an expedient inventive development, the ignition time instant is adjusted or triggered, per rotation or within the respective sequence, within a time interval that is defined or limited by the magnetic flux changes or resultant alternating-voltage charging half-waves having the greatest size or extent or the greatest amplitude within a sequence and also by the respective subsequent magnetic flux changes or alternating-voltage charging half-waves. In that case, it is of particular advantage to utilize magnetic flux changes or any second limb of the coil arrangement. Consequently, the ignition triggering can be flexibly programmed in this development. Therefore, as is disclosed above, a particular magnet wheel position relative to the ignition transformer is necessary for an optimally high-energy ignition spark. For a differing angular distance with respect to the starting curve, the triggering element would have to be advanced mechanically without the invention. On the basis of the invention, the criterion for the ignition time instant can be chosen or programmed easily, for example, by means of a threshold decision that can be triggered earlier on the basis of the input signals of the control derived from the coils.

According to DE 197 36 032 A1 mentioned at the outset, it is advantageous to set the control periodically to a defined (initial) state. For this purpose a RESET signal is generated by hardware means external to the control depending on the respective magnetic generator magnet wheel position and inputted into the control, as a result of which reinitialization is triggered. This has to take place outside the time interval for the calculation and adjustment of the ignition time instant since all the control activities have to be concluded by then and only start again for a repeat ignition cycle. Data stored within the control can, however, be maintained beyond the time instant of the RESET signal/reinitialization because the volatile working memory of the control (RAM) does not need to be erased in this process. In contrast, the invention proposes resetting and/or reinitializing the control synchronously with respect to predetermined positions of the internal combustion engine and of the magnetic generator synchronized thereto to an initial state at least twice per rotation. Simultaneously, an internal control time counter or a time counter interacting with the control is started in each case. If its count results are correlated with the occurrence in time of the alternating-voltage half-waves detected by the control, the direction of rotation, rotational position and/or rotational speed of the magnetic generator can be determined therefrom by means of the control or its arithmetic logic unit. These information items can be used as (functional) arguments for determining the ignition time instant, optionally with the aid of previously stored tables. The resetting or reinitialization at predetermined (rotational-angle) positions of the internal combustion engine or of the magnetic generator coupled thereto, for example, at sixty angular degrees before top dead center of the reciprocating piston and at the top dead center itself results in a first orientation and information item relating to the respective rotational angular position for the signal and data processing proceeding in the control. The fine angular position can then also be determined with the aid of the said time counter or time generator in combination-with threshold value decision circuits that can be programmed and sampled by the control.

In accordance with a further development of the idea of resetting twice per rotation, the latter takes place in each case in the half-waves that are used for the voltage supply to the control. In particular, to generate the RESET signals the first edge or, alternatively, the peak points of the half-waves can be used in each case. An advantage in conjunction with the coil arrangement distributed over two limbs can be achieved in that the control detects that the coil signals of different limbs have exceeded or dropped below the threshold and determines their relative position in time with respect to one another.

To increase the application flexibility of ignition modules having the features mentioned at the outset in regard to different magnet wheel/yoke limb geometries and simultaneously to achieve an optimal ignition spark burn-time, it is proposed within the scope of the general inventive idea to provide a microelectronic and/or programmable control for the ignition module that is connected to the coils for sampling, processing and/or rating their alternating-voltage half-waves and is designed to actuate the ignition switch as a function of the alternating-voltage half-waves. In this case, an input of the control provided for the voltage supply is connected to a coil of the second limb via a rectifier. The latter measure achieves the result that a charging coil mounted, for instance, on the first limb, is less impaired by the spatial distance from a voltage-supply coil on the second limb, preferably at its unsupported end, during the generation of the charging energy for the energy-storage element.

Furthermore, there is within the scope of the general inventive idea a computer program having program code elements that produce, during loading into a program memory of the control and starting of the computer program, electronically read-out control signals that interact with a processor of the control in such a way that the abovementioned method steps that can be executed by the control are implemented. Furthermore, there is, within the scope of the general inventive idea, a digital memory or carrier medium that comprises the program code elements and keeps them ready for the program memory of the control.

Further details, features, advantages and effects based on the invention emerge from the description below of preferred embodiments of the invention and also from the drawings. In each of the drawings:

BRIEF DESCRIPTION OF THE SEVERAL VIEWS OF THE DRAWINGS

FIG. 3*a* shows the position of the ignition angle plotted against various rotational speed ranges, FIG. 3*b* reproduces the voltage variations in the second yoke-core limb from FIG. 2*a,*

FIG. 3*c* shows the main voltage variation across the ignition-spark gap FU on the time-scale and in the time interval of FIG. 3*b,*

FIG. 3*c*1 shows an enlarged representation of the time interval circled in FIG. 3*c* for the voltage variation over the ignition-spark gap FU, FIG. 3*c*2 shows the burn current of the ignition-spark gap FU on the time-scale and in the time interval of FIG. 3*b,*

FIG. 3*d* shows the variation with time of the voltage supply to the control on the same time-scale and in the same time interval as according to FIGS. 3*b* and 3*c,*

FIG. 3*e* shows the variation with time of the reset signal RESET 1 for the control on the same time-scale and in the same time interval as according to FIGS. 3*b*–3*d,*

FIG. 3*f* shows an alternative variation with time of the reset signal RESET 2 on the same time-scale and in the same time interval as according to FIGS. 3*b*–3*e,*

DETAILED DESCRIPTION OF THE INVENTION

Figure 1:
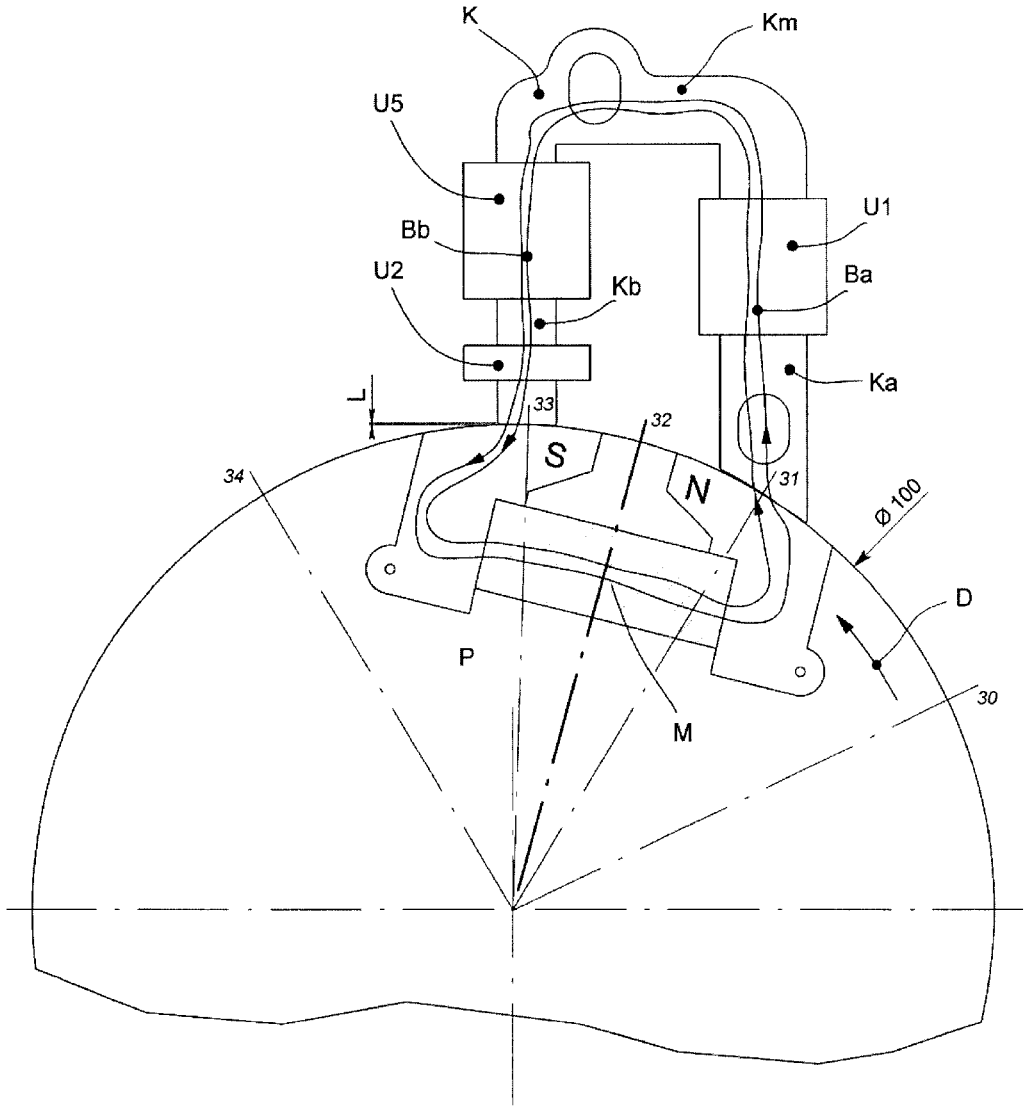
FIG. 1 shows diagrammatically in an axial, partial plan view, the design and the interaction of the magnetic generator with at least one part of the ignition module in the position that triggers the main flux change and the top-up effect according to the invention.

In accordance with FIG. 1, a magnet wheel P is provided and coupled to an internal combustion engine (not shown) in such a way that the magnet wheel P rotates synchronously with a crankshaft of the internal combustion engine. Incorporated structurally in the peripheral region of the magnet wheel P is a permanent magnet M around whose pole regions magnetically conducting pole shoes S, N are mounted. The said parts together form a magnetic generator P, M, S, N that is rotated by the internal combustion engine, for example, in a counter-clockwise direction of rotation D. In this process, the magnetic poles or pole shoe S (South Pole), N (North Pole) are moved past in their said sequence an iron soft-magnetic yoke core K, in each case first past its first limb Ka and then past its second limb Kb. The two limbs Ka, Kb are interconnected via a center section Km of the yoke core K to form a U shape. With every rotation in the direction D, the yoke core K or its limbs Ka, Kb are periodically passed through by a respective magnetic flux Ba or Bb via an air gap L. The limb Ka passed through first in the direction of rotation D is surrounded by a charging coil U1 in which a voltage is induced by the magnetic flux changes occurring during the passing rotation. In accordance with FIG. 4, an energy-storage element U4 in the form of an ignition capacitor is charged up by said charging voltage via a rectifier U3. An ignition switch U9 that can be connected to the input of the energy-storage element U4 and can be connected to ground is activated in a certain angular position (ignition time instant) by a trigger circuit or control U8, in which process the energy-storage element U4 discharges via the primary coil Lp of an ignition transformer U5. In accordance with FIG. 1, the latter is disposed with its primary and secondary coils Lp and Ls around the yoke-coil limb Kb as the second yoke-core limb occurring in the direction of rotation D. A voltage-supply coil U2 likewise surrounds the second yoke-core limb Kb in its end region adjacent to the air gap L. In accordance with FIG. 4, the output c of the voltage-supply coil U2 is connected to a voltage-supply unit U10 that generates the operating voltage VDD for the control U8, for example, a programmable microcontroller. Furthermore, the control is designed in such a way that it requires only a small amount of energy from the coil U2. For this purpose, the charging coil U2 is wound with the thin wire of the secondary winding Ls of the ignition transformer U5, from which manufacturing and storage advantages can be achieved.

Figure 4:
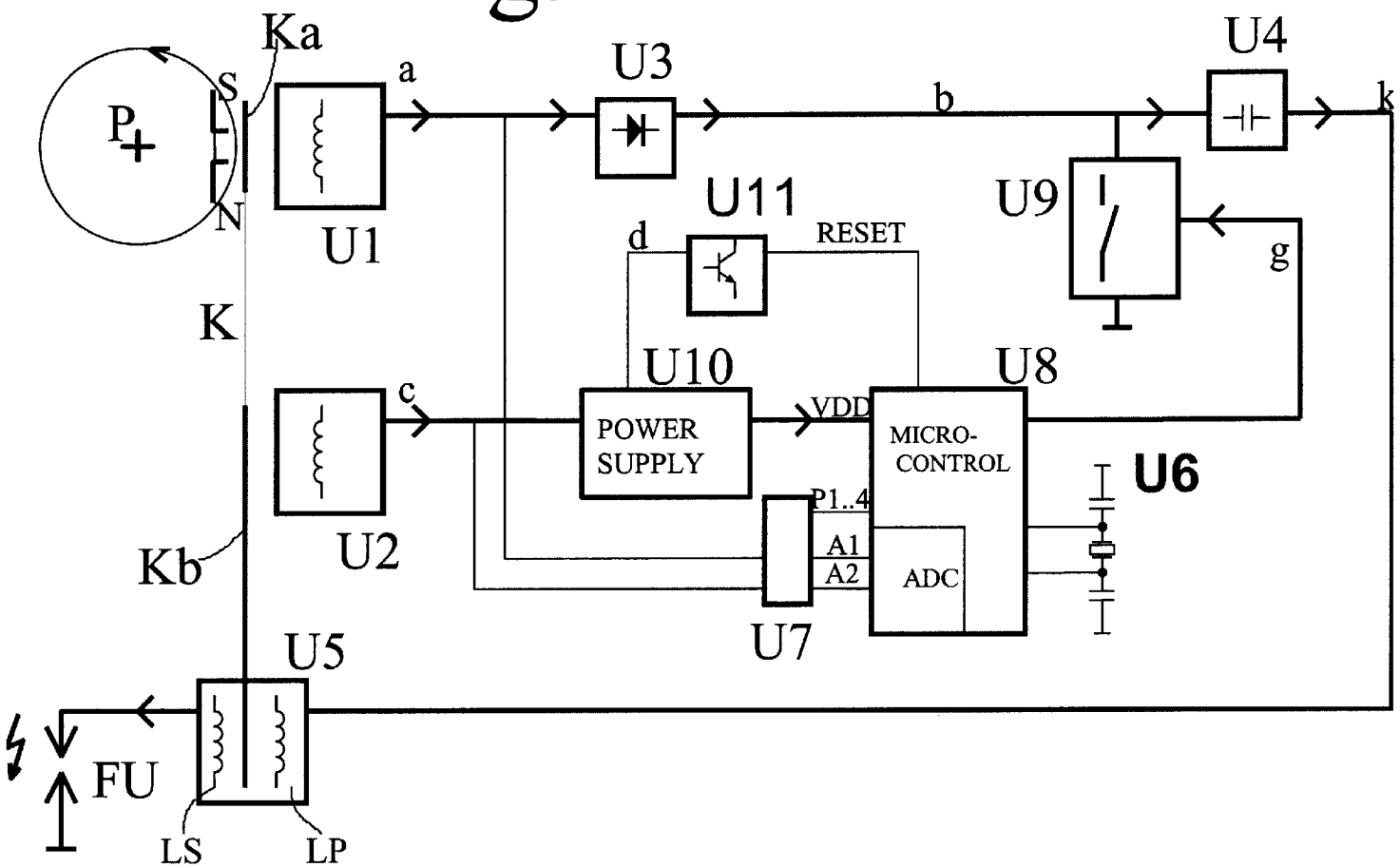
FIG. 4 shows a diagrammatic block circuit diagram for the ignition module according to the invention.

In accordance with FIG. 4, the control U8 is provided with one analog/digital converter ADC having at least the two analog signal-sampling inputs A1, A2. Connected upstream of the latter is a signal-level attenuation circuit U7 that can be adjusted by them by means of port terminals P1 . . . P4 of the control U8 and adapted to respective signal strengths of the coils (see FIG. 6 below). On the input side, the attenuation circuit U7 is connected to the output a of the charging coil U1 and in parallel with the output c of the voltage-supply coil U2 in order to feed said signals, attenuated according to states of the port terminals P1 . . . P4, to the signal sampling inputs A1, A2 of the control U8. With the aid of a clock generator U6 connected externally to the control U8, there can be formed internally in the control U8 a time generator or time counter that, in combination with the analog/digital converter ADC or, alternatively, a threshold-value decision circuit (see FIG. 6 below), can measure the respective time duration for various angular intervals on the basis of the alternating-voltage half-waves detected via the attenuation circuit U7, of the charging coil U1 and the voltage-supply coil U2. Depending on the evaluation of the time duration of the detected angular intervals, the ignition switch U9 is then actuated via the activation output g of the control U8 at the ignition time instant determined. The discharge side k of the ignition capacitor U4 is connected directly to the primary coil Lp, surrounding the second yoke-core limb Kb, of the ignition transformer U5. Coupled thereto is the secondary coil Ls, which is designed for transforming up and likewise surrounds the second yoke-core limb Kb and whose output is routed to the ignition spark gap FU.

Furthermore, in accordance with FIG. 4, the ignition module is provided with a reset circuit U11 whose output side d is fed from the voltage-supply unit U10. On the output side, the reset circuit U11 is connected to the RESET input of the control U8.

Figure 5:
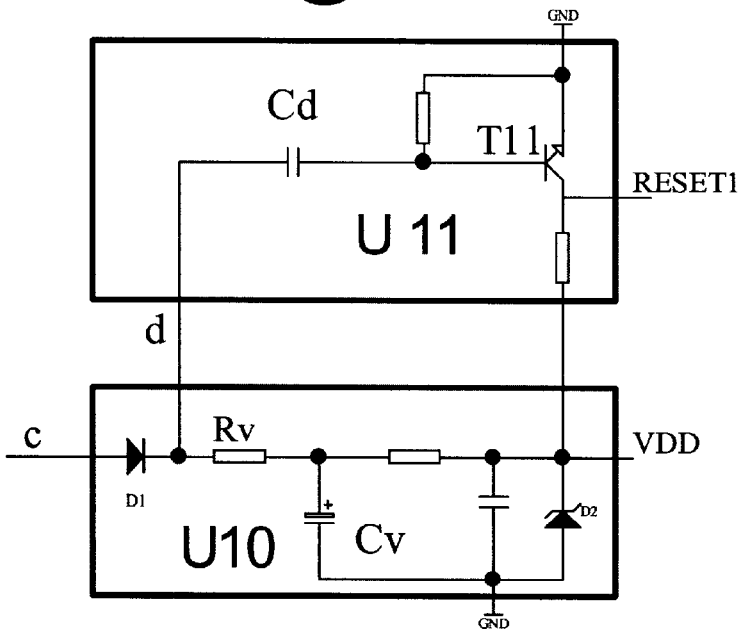
FIG. 5 shows, in an enlarged representation, the circuits for generating the reset signal and the voltage supply in each case for the control.

In accordance with FIG. 5, a first embodiment of the reset circuit U11 is formed with the output signal RESET 1 as pulse-shaping stage, comprising a differential capacitor Cd and a downstream transistor stage T11, from which the output signal RESET 1 is obtained for the control U8. The input signal for the reset circuit U11 is derived from the voltage-supply unit U10, namely directly downstream of its input rectifier D1. Alternatively, there is also a series connection (not shown) of two such pulse-shaping stages similar to one another within the scope of the invention, from which the alternative reset signal RESET 2 (cf. FIG. 3*f*) is derived and applied to the input pin RESET of the control U8. An advantage of the alternative reset series circuit having the output signal RESET 2 compared with the first-mentioned arrangement having a pulse-shaping stage U11 is that the ignition time instant can be triggered with still more delay. During the active RESET input signal (having, as a rule, low level), the control cannot operate. According to the second-mentioned alternative in accordance with FIG. 3*f*, the output level RESET 2 having a needle-like dip, is at low only at a later angular position. Within the framework of the said series connection, the signal RESET 1 forms, in accordance with FIG. 3*e*, the input signal for the second pulse-shaping stage (not shown) in which case a signal rise of the input signal RESET 1 denotes a low level of the output signal RESET 2 according to FIG. 3*f*. The differential capacitor Cd in the second similar stage of the alternative reset circuit generates a positive voltage at the base of the transistor T11 in the common emitter circuit, resulting in the output signal RESET 2 of FIG. 3*f*, rotated by 180 degrees in phase. Consequently, the control can operate actively for a longer time period, that is to say trigger an ignition spark also in a later angular position.

In accordance with FIG. 5, the energy for the voltage-supply unit U10 of the control U8 is obtained from the voltage-supply coil U2 on the second yoke-core limb Kb in conjunction with a magnetic flux change and fed via the coil output c to the input rectifier D1. In order to limit the energy drawn by the voltage-supply coil U2, it is expedient to fix the number of turns of the voltage-supply coil at <1000 and/or to connect, between coil or input rectifier D1 and voltage-supply capacitor Cv, a series resistor Rv whose resistance, together with the internal resistance of the voltage-supply coil, is greater than 100 ohm. Expediently, the capacitance of the voltage-supply capacitor Cv is not more than 33 $\mu$F, preferably 22 $\mu$F. Furthermore, it is expedient to use a control, in particular a microcontroller, having a large supply-voltage range. For this purpose, types with 2.5 V . . . 5.5 V and a voltage consumption of <1 mA are at present available on the market. Finally, in accordance with FIG. 5, an RC low-pass filter (connected to ground GND) and a voltage-stabilizing diode D2 are disposed downstream of the voltage-supply capacitor Cv inside the voltage-supply unit U10. The operating voltage VDD for the control is drawn from the anode terminal of the latter.

Figure 6:
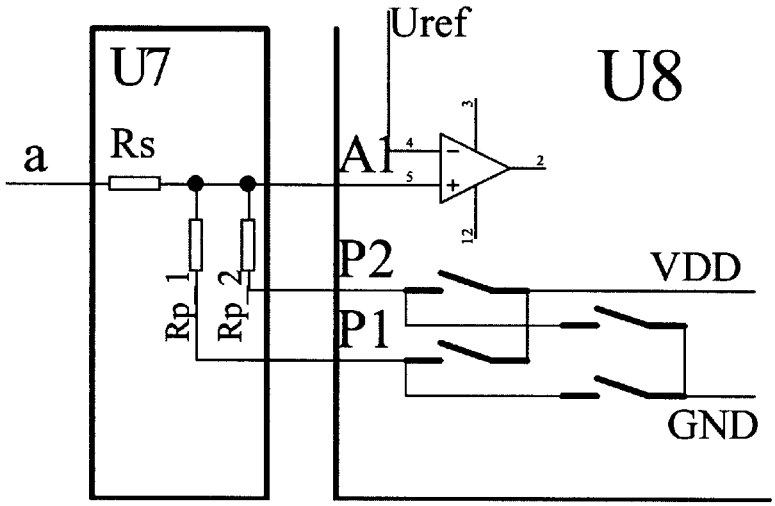
FIG. 6 shows a section of the control with signal sampling inputs and upstream signal-level attenuation circuit.

In accordance with FIG. 6, the attenuation circuit or level shifter U7 serving to couple the control U8 to the output signals a,c of the charging and voltage-supply coils U1, U2 comprises a voltage divider having the low-end resistors Rp1, Rp2 assigned to the charging-coil half-waves and further low-end resistors that are assigned to the voltage-supply coil half-waves and connected to the control ports P3, P4 (see FIG. 4 for the latter). The voltage divider shown in FIG. 6 of the attenuation circuit U7 is programmable by means of the control U8 via its ports P1, P2 in that the low-end resistors Rp1, Rp2 can be switched to operating-voltage potential VDD, to ground GND or to a high-resistance state by internal port transistors (see switching elements in FIG. 6). As a result of this, voltage range, triggering and polarity can be adjusted for the control U8. Similar remarks apply to the voltage divider (not shown) that is assigned to the output signal c of the voltage-supply coil U2.

The following is set out below with respect to the mode of operation of the ignition system according to the invention:

FIG. 1 shows for the magnetic generator M, S, N its radial symmetry lines in various rotational positions 30, 31, 32, 33, 34. These correspond to the magnetic flux changes 1, 3, 5, 7 in FIG. 2*d* and also 9, 11, 13, 15 in FIG. 2*b* and to the alternating-voltage half-waves 2, 4, 6, 8 in FIG. 2*c* and 10, 12, 14, 16 in FIG. 2*a*, in which connection the variations with time shown for the individual limb magnetic fluxes Ba, Bb and the coil voltages U1, U2 or U5 are plotted on the same time-scale and in the same time intervals with respect to one another in accordance with their respective time-synchronous occurrence with respect to one another. The voltages on the Y-axes are shown with different scales, depending on different numbers of coil turns. To illustrate the physical relationships better, the occurrence of the rotational positions 30–34 are also marked in FIGS. 2*a* to 2*d*. As is evident from FIG. 3*b*, within one rotation or half-wave sequence, the voltage-supply unit U10 is supplied for the first time from the positive alternating-voltage half-wave 12 with energy at a peak voltage 18, with the result that the control U8 can operate roughly from 60 degrees onwards prior to top dead center OT. The engine angular speed is still comparatively high under these circumstances and the angular speed dips sharply only with increasing approach to top dead center OT (cf. peak voltage 19 in FIGS. 3*b* and 2*a*). So that the control U8 manages with as low energy consumption as possible from the voltage-supply unit U10, the latter is available only with the triggering of a RESET signal roughly from the center of the second charging-voltage half-wave 4 in accordance with FIG. 2*c* (cf. also dotted vertical line in FIGS. 2*a*–2*d*) up to the calculated ignition time instant Zzp, in particular in the lowest rotational-speed range, that is to say during engine starting. From the corresponding dotted vertical line 31 passing through the respective time axes in FIGS. 2*a*–*d*, the control can detect the voltage half-waves of the charging coil U1 and of the voltage-supply coil U2 in terms of signal by means of the attenuation circuit and process or evaluate them for the purpose of calculating the ignition time instant. The currents that still flow via the attenuation circuit U10 can be neglected in regard to the energy consumption because of the high internal resistances.

The energy-storage element U4 is expediently precharged at the end of a half-wave cycle 2-4-6-8 from the charging coil U1 with the last half-wave 8 and then charged up further in the next cycle for the coming ignition time instant Zzp with the strongest half-wave of the charging coil U1.

To detect and process the coil signals, a microcontroller with comparator and programmable reference voltage Uref (cf. FIG. 6) may also be used in addition to the analog/digital converter ADC incorporated in accordance with FIG. 4 in the control U8. The variant mentioned second is beneficial for internal combustion engines that are revving up because attainment or passage through preset threshold-value voltages can be detected more rapidly for subsequent processing. Such microcontrollers are at present marketed by various semiconductor producers. The concept of sampling the alternating-voltage half-waves and of detecting and measuring their rising or falling edges also makes it possible, in conjunction with such microcontrollers, to perform, in the starting and idling rotational-speed range, the detection of the direction of rotation advantageous for low rotational speeds within an angular range from the peak voltage 18 of the second positive half-wave according to FIGS. 2*a* and 3*b* up to the ignition time instant in accordance with the method disclosed in the prior Patent Application DE 101 07 070.5.

With each initialization in the region of the peak voltages 18, 19 of the voltage-supply coil U2, the internal time generator of the control U8 is started and continuously counts, from the respective initialization time instant 18, 19, internal pulses, derived from the clock generator, at constant intervals of, for example, one microsecond. In combination therewith, respective time marks t1–t6 are stored (cf. FIG. 3*b*) for events occurring at the signal sampling inputs A1, A2 (for example, a coil signal dropping below or exceeding a threshold value preprogrammed for the analog/digital converter ADC in accordance with FIG. 4 or the threshold-value decision circuit in accordance with FIG. 6). For example, the time instants of the respective first undershootings of preprogrammed, negative voltage thresholds by signals from the charging coil U1 on the first yoke-core limb Ka and the voltage-supply coil U2 on the second yoke core limb Kb are rated with respect to one another. The time t2 (cf. FIG. 3*b*) elapsing within a half-wave sequence from the peak voltage 18 of the second half-wave to the undershooting of a preprogrammed, negative voltage threshold (corresponding, for example, to an angular position of 45 degrees prior to top dead center OT) can be converted in a data-processing operation of the control into a value above the rotational speed of the internal combustion engine. Further time marks t3, t4, t5 can be counted and stored in further angular positions, from which the change in the angular speed with increasing approximation to top dead center is obtained. If the angular speed corresponds to an idling or working rotational-speed range (for example 2000 or 5000 revolutions per minute, respectively) during which the operating voltage VDD is certainly present over a rotation of 360 degrees, a further angular range or time interval t6 can be measured that extends from the occurrence in time of the respective second reset signal RESET 1, RESET 2 of a half-wave sequence (FIG. 3*e*, FIG. 3*f*) in the region of the last peak voltage 19 or of top dead center OT to the occurrence of the first alternating voltage half-wave 10 (roughly 90 degrees prior to top dead center, see FIG. 3*b*) and is essentially a measure of the mean engine rotational speed n. Correspondingly, a further time mark can be stored for said time interval t6 and a time delay function tv=f(t6) can be calculated and used to trigger the ignition time instant Zzp.

Figures 2A, 2B, 2C, 2D:
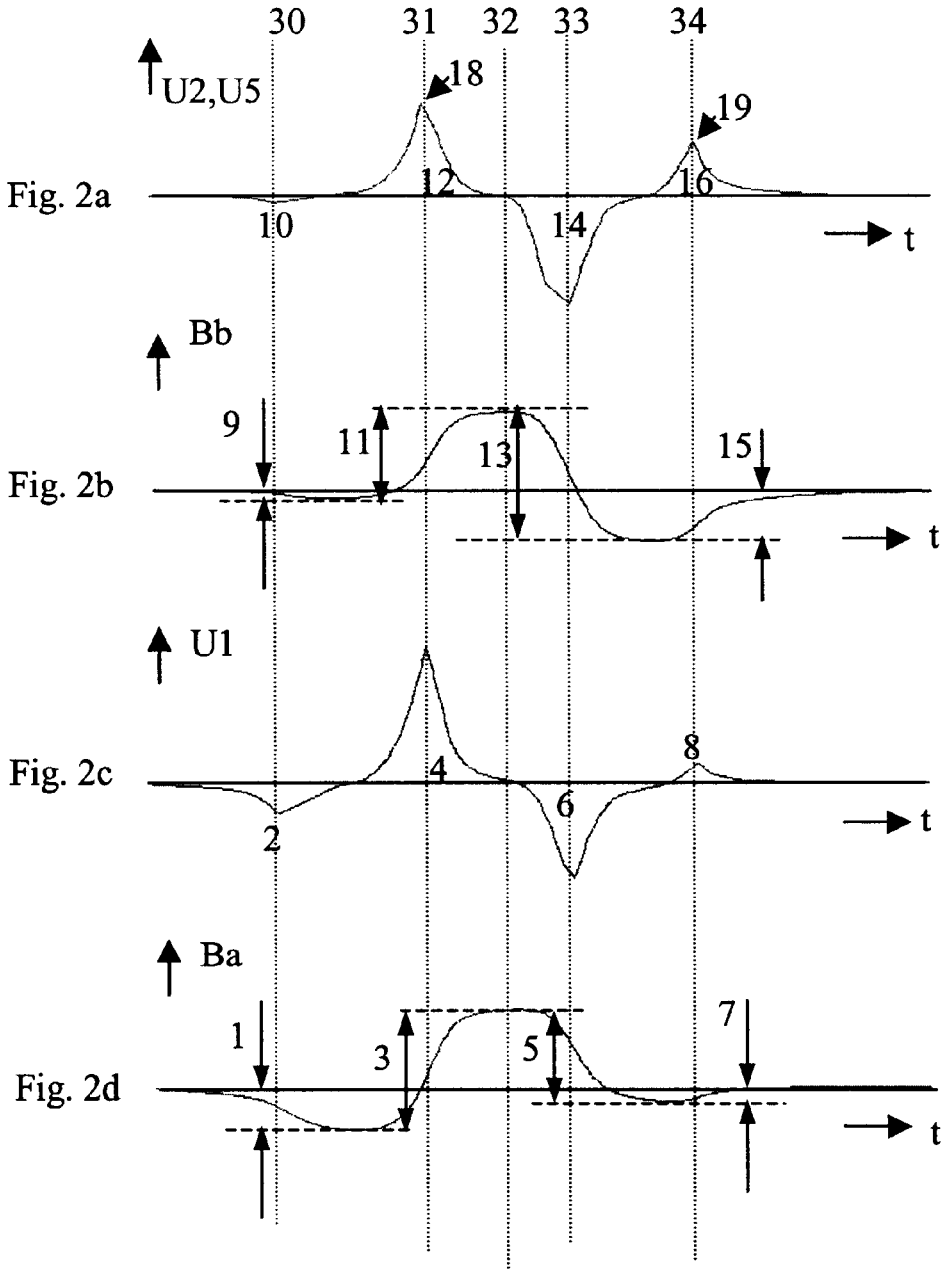
FIGS. 2*a*–2*d* show the variation with time of the voltages and magnetic fluxes prevailing in the coils with respect to one another on scales that are different in each case in the time intervals and on the time-scales that are the same in each case.

According to the invention, the ignition time instant delay time function tv=f(t6) is chosen or programmed or stored as a table in the control U8 in such a way that the ignition time instant Zzp is set in the angular range of the strongest magnetic flux change 13 in the second limb Kb or of the alternating voltage half-wave 14 having the greatest amplitude (cf. FIG. 2*b* or FIG. 2*a*). Up till then, further rotational-speed and angular-position information items can be detected on the basis of the exceeding or undershooting of voltage thresholds having the time marks t1, t2 or even t3 via the signal sampling inputs A1, A2, processed in the control and concomitantly taken into account as arguments for the ignition time instant adjustment. That is to say the information items relating to direction of rotation and rotational angular position of the crankshaft and the engine rotational speed can be determined up to the ignition time instant Zzp and included in the further ignition control processes.

At the ignition time instant Zzp (cf. FIGS. 3*c*, 3*c*1 and 3*c*2), a discharge oscillating in a damped manner of the energy-storage element U4 starts via the ignition switch U9 through the ignition coil U5 or its primary coil Lp. In this process, energy oscillates back and forth between the primary coil Lp and the energy-storage element or ignition capacitor U4. The primary current produced thereby induces a high-voltage pulse in the secondary coil Ls closely coupled to the primary coil Lp. When an ionization voltage Uion (cf. FIG. 3*c*1) is exceeded, this triggers a spark flashover at the spark gap FU. In accordance with FIG. 3*c*1, a pulsating ignition spark voltage Ufu with which an alternating burn current IB is likewise associated for the time duration tb1 (of approximately 100 $\mu$s) is then present for a further time duration tb1 in the ignition spark gap. Both the ignition spark voltage UFu and the burn current IB substantially exceed, within the first time interval tb1, the voltage thresholds or current thresholds UB or IB2, respectively, that are necessary to maintain the ignition spark burn.

In that, according to the invention, the ignition time instant is set in the region of the strongest magnetic flux change 13 or of the magnitudinally largest half-wave amplitude 14 in the respective coils U2, U5 of the second yoke-core limb Kb for each rotation or sequence, the energy content of the ignition spark is maximized. In addition, the voltage induced in the secondary coil Ls by the strongest magnetic flux change 13 with at least the burn-voltage threshold UB being reached prolongs the burn current IB, according to the invention, by a second, possibly prolonged time duration tb2 (cf. FIGS. 3*c*1 and 3*c*2). This ensures a reliable and efficient combustion of the fuel mixture of the internal combustion engine. The abovementioned Patent Publication DE 197 36 032 discloses an achievement only of maintaining the alternating voltage discharge tB1, but not of intensifying the second time duration tB2. In accordance with the example shown in FIGS. 3*b* and 3*c*, the burning of the ignition spark terminates roughly between the time intervals or time marks t4 and t5 (cf. dotted vertical line), that is to say still prior to top dead center OT.

In accordance with FIGS. 3*a* and 3*b*, in the starting rotational-speed range, the ignition triggering does not take place in the region of the strongest magnetic flux change 13, but closer to top dead center after the time interval t5 due to the rising edge of the last alternating voltage half-wave 16 of the voltage-supply coil U2 of the second yoke core limb Kb. If an earlier ignition time instant Zzp is necessary, the ignition triggering threshold can also be assigned to an edge of the penultimate half-wave 14. For this purpose, a voltage threshold can be programmed in each case as ignition threshold ZS in the control U8. With rising passage through the ignition threshold ZS by the third or fourth alternating voltage half-wave 14, 16 within a sequence or a cycle, the ignition time instant Zzp is correspondingly triggered or the ignition FU is initiated.

The voltage variation of the voltage supply or of the operating voltage VDD shown in FIG. 3*d* is valid for low rotational speeds in the starting range. For higher rotational speeds, gaps present in the operational-voltage signal are closed, the signal is smoothed out and is present over an angular range of 360 degrees. A residual ripple remains.

In accordance with FIGS. 3*e* or 3*f*, the control is reset or initialized after ignition triggering, as indicated by the short negative voltage dip of the signal RESET 1 or the second needle-like dip of the signal RESET 2 in FIGS. 3*e* and 3*f*, respectively, in each case at the time instant of the peak 19 of the fourth voltage half-wave 16 (FIG. 2*a*). These dips therefore take place in each case in the region of the last half-wave 16 of the voltage-supply coil U2 in time. In the next sequence, its second voltage half-wave 12 again serves as a basis for the first reinitialization of the control U8 per rotation or cycle (sequence), associated with starting of the internal time generator and subsequent provision of overshoots and undershoots of voltage thresholds having time marks t1–t5.

The respective last peak voltage 19 of a half-wave sequence or the time instant of the respective second reset signal RESET 1, RESET 2 (FIG. 3*e*, FIG. 3*f*) is in a rotational angular range of 15 degrees before up to roughly 10 degrees after top dead center OT of the internal combustion engine. Since the position of the ignition time instant Zzp in the working rotational-speed range is determined by the flux change and the ignition time instant Zzp is specified relative to top dead center OT of the respective internal combustion engine, top dead center OT and the time instant of the last peak voltage do not coincide precisely.

Accordingly, the respective second peak voltage 18 or the respective first reset signal RESET 1, RESET 2 is 50 to 70 angular degrees prior to the respective second reset signal RESET 2.

List of Reference Symbols

P Magnet wheel
M Permanent magnet
S, N Pole shoe
D Direction of rotation
K Yoke core
Ka First limb
Kb Second limb
Km Center section
L Air gap
Ba, Bb Magnetic flux
U1 Charging coil
U3 Rectifier
U4 Energy-storage element
U9 Ignition switch
U8 Control
U5 Ignition transformer
U2 Voltage-supply coil
U10 Voltage supply unit
VDD Operating voltage
ADC Analog/digital converter
A1, A2 Signal sampling inputs
U7 Signal-level attenuation circuit
P1 . . . P4 Port terminals
a Charging coil output
c Voltage-supply coil output
U6 Clock generator
g Activation output
k Discharge side
Lp Primary coil
Ls Secondary coil
FU Ignition spark gap
U11 Reset circuit
d Input side of U11
RESET Input of U8
Cd Differential capacitor
T11 Transistor stage
RESET 1, 2 Output signals
D1 Input rectifier
Rv Series resistor
Cv Voltage supply capacitor
GND Ground
D2 Voltage-stabilizing diode
30–34 Rotational positions of symmetry lines
1, 3, 5, 7 Magnetic flux change in first limb Ka
9, 11, 13, 15 Magnetic flux change in second limb Kb
2, 4, 6, 8 Alternating voltage half-waves of charging coil U1
10, 12, 14, 16 Alternating voltage half-waves of the coils U2, U5
18, 19 Peak voltages of U2, U5
OT Top dead center
t1–t6 Time mark
Zzp Ignition time instant
Uion Ionization voltage
tB1 First time duration
tv Ignition time instant delay time
UFu Ignition spark voltage
IB Burn current
UB Burn voltage threshold
IB2 Burn current threshold
tB2 Second time duration
ZS Ignition threshold
n Rotational speed
Rs Series resistor

What is claimed is:

1. An electrical ignition method for internal combustion engines using an arrangement of a plurality of coils and of a magnetic generator that rotates synchronously with the engine and whose magnetic field at the same time flows periodically through the coils and generates therein a sequence of magnetic flux changes per rotation, a sequence of corresponding alternating-voltage half-waves being induced in the coils that are used:

to charge an energy-storage element, that is discharged by actuation of an ignition switch via a primary-coil winding of an ignition transformer to trigger an ignition spark, and to form a voltage supply for a microelectronic control that is used to actuate an ignition switch in an ignition time instant as a function of the alternating-voltage half-waves detected or of the state of the internal combustion engine, wherein, within one rotation, there is chosen, for the triggering of the ignition spark to prolong its burn-time, such a time interval in which the a coil winding is specifically influenced by one of the magnetic flux changes and the magnetic flux change used to prolong the burn-time is greatest within the respective sequence.

2. An electrical ignition method for internal combustion engines, as claimed in claim 1, using an arrangement of a plurality of coils and of a magnetic generator that rotates synchronously with the engine and whose magnetic field at the same time flows periodically through the coils and generates therein a sequence of magnetic flux changes per rotation, a sequence of corresponding alternating-voltage half-waves being induced in the coils that are used:

to charge an energy-storage element, that is discharged by actuation of an ignition switch via a primary-coil winding of an ignition transformer to trigger an ignition spark, and to form the voltage supply for a microelectronic control that is used to actuate the ignition switch in an ignition time instant as a function of the alternating-voltage half-waves detected or of the state of the internal combustion engine, wherein, within one rotation, there is chosen, for the triggering of the ignition spark to prolong its burn-time, such a time interval in which the coil winding is specifically influenced by one of the magnetic flux changes, use of the alternating voltage half-waves in this time interval being excluded at least for the formation of the voltage supply.

3. An ignition method as claimed in claim 2, wherein, in said time interval, use of the alternating-voltage half-waves is excluded for the charging of the energy-storage element.

4. An ignition method as claimed in claim 1 or claim 2 or claim 3, with use of a coil arrangement extending constructionally and geometrically over a first and a second limb, its first and then its second magnetic pole being moved past, within one rotation of the magnetic generator, in each case consecutively the first and then the second limb, wherein the magnetic flux change occurring at a third position in time per rotation or sequence in the second limb is fed directly to the ignition transformer and, in the process, being used to prolong the ignition spark burn-time.

5. An ignition method as claimed in claim 4, wherein the alternating voltage half-waves across assigned coils occurring in the first and second limb per rotation or sequence in each case at the second position in time are used substantially simultaneously to charge the energy storage element and for the purpose of voltage supply to the control.

6. An ignition method as claimed in claim 4, wherein, to form the voltage supply, one of the alternating voltage half-waves of the second limb is used within the respective rotation or sequence in that time interval in which the magnetic flux change having the greatest magnitude occurs in the first limb and is available to be used to charge the energy-storage element.

7. An ignition method as claimed in claim 4, wherein, to form the voltage supply, those alternating voltage half-waves are used that originate from the magnetic flux changes that occur in the second limb and within the respective rotation or sequence therein at the second or fourth position in time of the respective sequence and with the second-largest or third-largest magnitude.

8. An ignition method as claimed in claim 4, wherein alternating voltage half-waves of the coils both of the first and of the second limb are fed to the control for processing and, in this process, are placed in time relationship with respect to one another, from which the control determines direction of rotation, rotational position or rotational speed of the magnetic generator for the purpose of adjusting and triggering the ignition time instant.

9. An ignition method as claimed in claim 4, wherein the ignition time instant, in a rotational-speed range corresponding to the starting of the internal combustion engine, is triggered by the control within a time interval that corresponds as a maximum to a rotation of the magnetic generator through roughly 80 degrees.

10. An ignition method as claimed in claim 4, wherein, within the respective sequence, the ignition time instant is triggered within a time interval that is defined by the magnetic flux change having the greatest magnitude within the sequence and also by a respective subsequent magnetic flux change.

11. An ignition method as claimed in claim 4, wherein, at least twice per rotation, the control is reset synchronously at predetermined positions of the magnetic generator or of the internal combustion engine to an initial state and, in this process, a control time counter is started in each case whose counting results are correlated with the occurrence in time of alternating voltage half-waves detected by the control, from which direction of rotation, rotational position or rotational speed of the magnetic generator are determined by means of the control for the purpose of adjusting the ignition time instant.

12. An ignition method as claimed in claim 11, wherein the corresponding reset signals are derived from alternating voltage half-waves that are at the second or fourth position in a sequence and are used to form the voltage supply.

13. An ignition method as claimed in claim 11, wherein a respective second reset signal within a sequence is triggered at a rotational position that corresponds to a rotational angular range of roughly 15 degrees before and 10 degrees after top dead center of the internal combustion engine and a respective first reset signal within a sequence corresponds to a rotational angular range of 50 to 70 degrees prior to the respective second reset signal.

14. An ignition method as claimed in claim 1, in which, within one rotation of the magnetic generator, its first and then its second magnetic pole is moved past the charging coil used to charge the energy-storage element and, in the process, a sequence of four alternating voltage half-waves is generated in the charging coil, wherein both the last alternating voltage half-wave of the respective sequence and the largest alternating voltage half-wave of the next sequence are used to charge the energy-storage element.

15. An ignition module, having a magnetizable yoke core that is surrounded by a plurality of induction coils and that has at least a first limb surrounded by a charging coil and a second limb surrounded at least by primary and secondary coils of an ignition transformer having an energy-storage element that is connected to the charging coil and that can be discharged by means of an ignition switch via a primary-coil winding of the ignition transformer to trigger an ignition spark, wherein a microelectronic control is connected to the coils for sampling, processing and rating the alternating voltage half-waves of the latter and is designed to actuate the ignition switch as a function of the alternating voltage half-waves, an input of the control being connected to a coil of the second limb via a rectifier for the purpose of its voltage supply.

16. An ignition module as claimed in claim 15, wherein a separate voltage-supply coil is mounted on the second limb for the purpose of supplying the rectifier for the control.

17. An ignition module as claimed in claim 16, wherein the separate voltage-supply coil is constructed with a wire of the same electrical resistance as the secondary coil of the ignition transformer.

18. An ignition module as claimed in claim 16 or 17, wherein the voltage-supply coil is mounted in the end region of the second limb.

19. An ignition module as claimed in claim 15, wherein the control is connected for the purpose of signal sampling via one input in each case to coils both of the first and second limb for the purpose of processing their alternating voltage half-waves.

20. An ignition module as claimed in claims 19, wherein the signal sampling inputs detect alternating voltage half-waves both the charging coil on the first limb and of the voltage-supply coil, connected to the rectifier on the second limb.

21. An ignition module as claimed in claim 19 or claim 20, wherein a signal-level attenuation circuit is connected upstream of the signal sampling inputs of the control.

22. An ignition module as claimed in claim 21, wherein the attenuation circuit comprises a resistor network that is combined with binary port terminals of the microelectronic control to form a programmable voltage divider.

23. An ignition module as claimed in claim 15, wherein a reset circuit is connected to at least one coil of the second limb and is designed to respond to the second and fourth alternating voltage half-waves of a sequence.

* * * * *